US012507731B2

(12) United States Patent
Van Lancker et al.

(10) Patent No.: US 12,507,731 B2
(45) Date of Patent: Dec. 30, 2025

(54) AEROSOL-GENERATING DEVICE WITH PYROCATALYTIC MATERIAL

(71) Applicant: Philip Morris Products S.A., Neuchatel (CH)

(72) Inventors: Pieter Van Lancker, Kortrijk (BE); Louis-Philippe Vancraeynest, Kortrijk (BE); Simon Desnerck, Kortrijk (BE)

(73) Assignee: Philip Morris Products S.A., Neuchatel (CH)

( * ) Notice: Subject to any disclaimer, the term of this patent is extended or adjusted under 35 U.S.C. 154(b) by 1133 days.

(21) Appl. No.: 16/973,566

(22) PCT Filed: Jun. 13, 2019

(86) PCT No.: PCT/EP2019/065461
§ 371 (c)(1),
(2) Date: Dec. 9, 2020

(87) PCT Pub. No.: WO2019/238809
PCT Pub. Date: Dec. 19, 2019

(65) Prior Publication Data

US 2021/0251290 A1 Aug. 19, 2021

(30) Foreign Application Priority Data

Jun. 14, 2018 (EP) ..... 18177754

(51) Int. Cl.
*A24F 40/46* (2020.01)
*A24F 40/20* (2020.01)
*A24F 40/85* (2020.01)

(52) U.S. Cl.
CPC ..... *A24F 40/46* (2020.01); *A24F 40/85* (2020.01); *A24F 40/20* (2020.01)

(58) Field of Classification Search
None
See application file for complete search history.

(56) References Cited

U.S. PATENT DOCUMENTS 3,545,423 A 12/1970 Morgan
3,761,293 A * 9/1973 Carini ..... C03C 4/00 501/59

(Continued)

FOREIGN PATENT DOCUMENTS

CA 2 244 210 C 4/2006
CN 106231931 A 12/2016

(Continued)

OTHER PUBLICATIONS

Official Action issued on Jul. 8, 2021 in Russian Patent Application No. 2021100163 (submitting English translation only), 5 pages.

(Continued)

*Primary Examiner* — Michael J Felton
(74) *Attorney, Agent, or Firm* — Oblon, McClelland, Maier & Neustadt, L.L.P.

(57) ABSTRACT

An aerosol-generating device for generating an inhalable aerosol is provided, the aerosol-generating device including: a heating chamber including a sidewall; and a heating element disposed in the heating chamber, a pyrocatalytic material being applied to one or more of the heating element and a sidewall of the heating chamber as a coating, and the heating element being configured for pyrocatalytic cleaning. A method for cleaning a heating chamber of an aerosol-generating device is also provided.

16 Claims, 3 Drawing Sheets

(56) References Cited

U.S. PATENT DOCUMENTS

Figure 1:
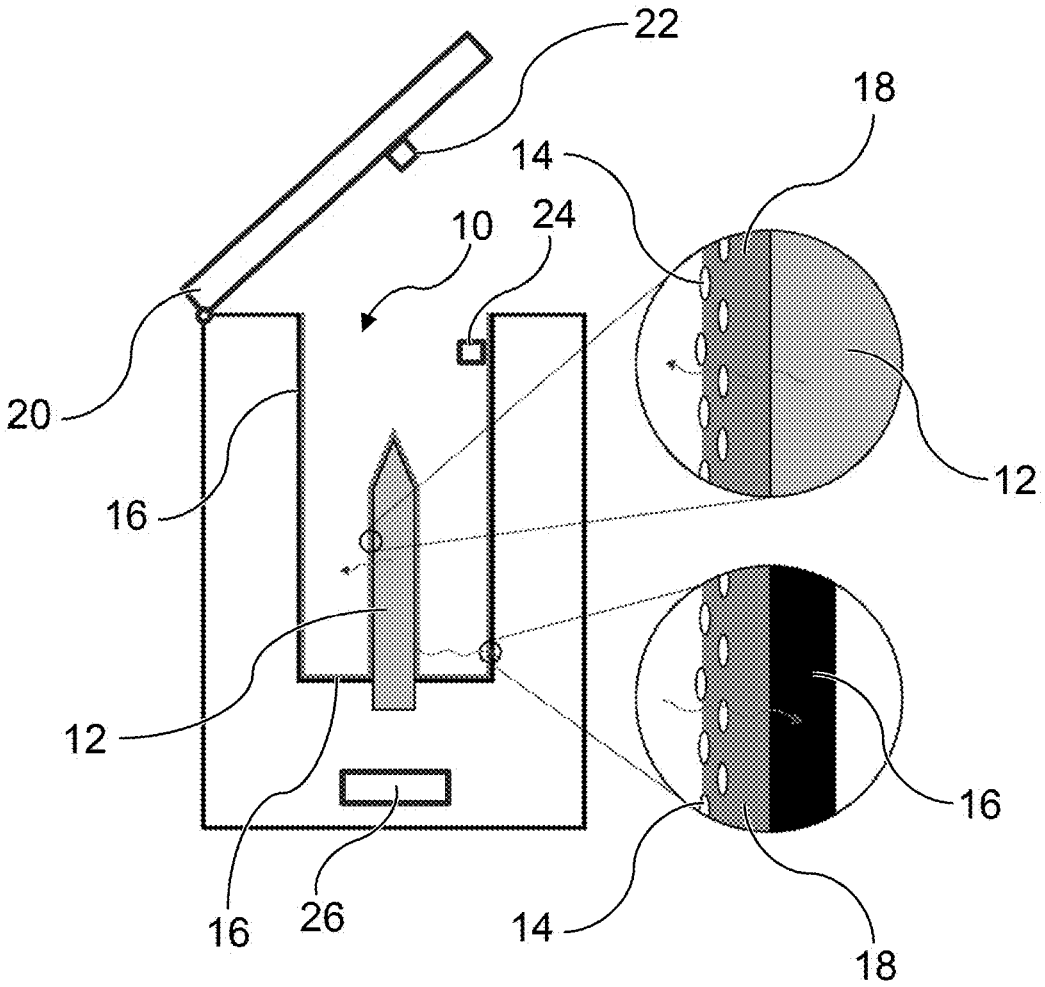

| | | | | |
|---|---|---|---|---|
| 5,878,752 | A | 3/1999 | Adams et al. | |
| 7,854,222 | B2 | 12/2010 | Venkataramani et al. | |
| 2006/0151474 | A1 | 7/2006 | Pessayre et al. | |
| 2013/0042865 | A1* | 2/2013 | Monsees ..... | A61M 15/0025 128/203.27 |
| 2013/0255721 | A1 | 10/2013 | Tyrrell et al. | |
| 2014/0238379 | A1 | 8/2014 | Venkataramani et al. | |
| 2015/0282525 | A1 | 10/2015 | Plojoux et al. | |
| 2017/0055580 | A1* | 3/2017 | Blandino ..... | H05B 6/36 |
| 2017/0188634 | A1 | 7/2017 | Plojoux et al. | |

FOREIGN PATENT DOCUMENTS

| | | | |
|---|---|---|---|
| CN | 107920599 | A | 4/2018 |
| CN | 107920602 | A | 4/2018 |
| EP | 0 897 271 | A1 | 2/1999 |
| EP | 2 609 821 | A1 | 7/2013 |
| GB | 1 307 989 | A | 2/1973 |
| JP | 2001-238658 | A | 9/2001 |
| JP | 2004-50764 | A | 2/2004 |
| JP | 2015-504669 | A | 2/2015 |
| JP | 2015-508287 | A | 3/2015 |
| RU | 2014 131 458 | A | 2/2016 |
| WO | WO 98/23171 | A1 | 6/1998 |
| WO | WO 2011/050964 | A1 | 5/2011 |
| WO | WO 2013/098411 | A1 | 7/2013 |
| WO | WO 2013/102611 | A2 | 7/2013 |
| WO | WO 2015/128499 | A1 | 9/2015 |
| WO | WO 2015/165709 | A1 | 11/2015 |
| WO | WO 2017/011419 | A1 | 1/2017 |
| WO | WO 2017/036955 | A2 | 3/2017 |
| WO | WO 2019/170901 | A1 | 9/2019 |

OTHER PUBLICATIONS

European Communication of a Notice of Opposition issued Oct. 6, 2023 in European Patent Application No. 19731664.9, 39 pages.

"Cleaning", Wikipedia, retrieved from https:/ /en.wikipedia.org/w/index.php?title=Cleaning&oldid=1172967721, Aug. 30, 2023, 4 pages.

Japanese Office Action issued Feb. 7, 2022 in Japanese Patent Application No. 2021-617529 (submitting English translation only), 3 pages.

Combined Chinese Office Action and Search Report issued Feb. 13, 2023, in corresponding Chinese Patent Application. No. 201980034886.2 (with English Translation), 19 pages.

International Search Report and Written Opinion issued Oct. 8, 2019 in PCT/EP2019/065461 filed Jun. 13, 2019.

* cited by examiner

Fig. 2
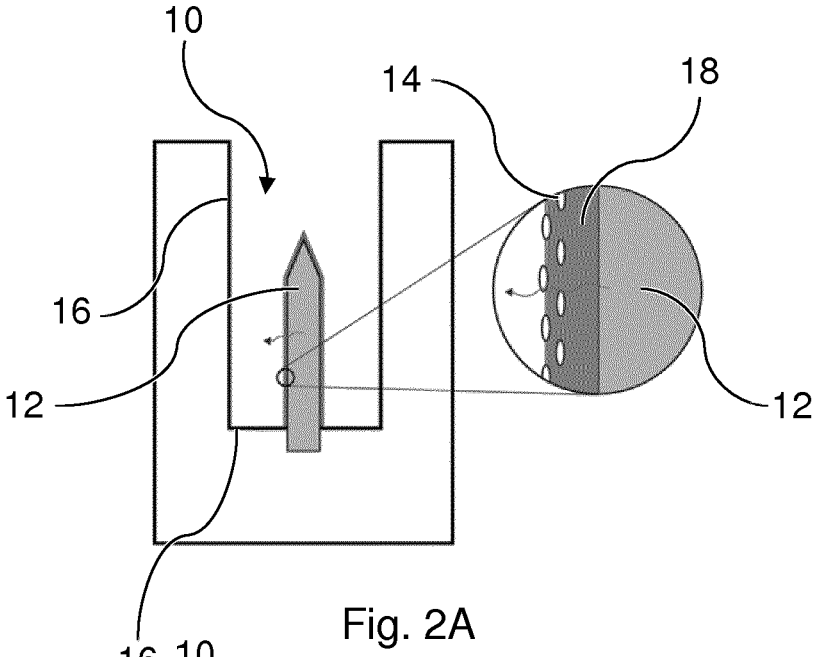
Fig. 2A
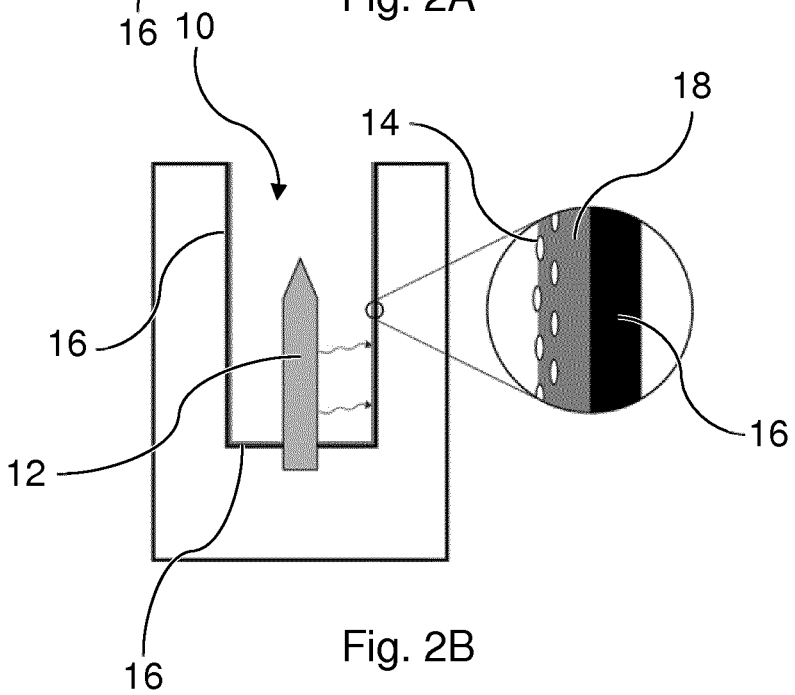
Fig. 2B

AEROSOL-GENERATING DEVICE WITH PYROCATALYTIC MATERIAL

The invention relates to an aerosol-generating device for generating an inhalable aerosol. Aerosol-generating devices are known which heat but not burn aerosol-generating substrate such as tobacco. These devices heat aerosol-generating substrate to a sufficiently high temperature for creating an aerosol for inhalation by the user.

These aerosol-generating devices typically comprise a heating chamber, wherein a heating element is arranged within the heating chamber. An aerosol-generating article comprising aerosol-generating substrate can be inserted into the heating chamber and heated by the heating element. The heating element is typically configured as a heating blade and penetrates into the aerosol-generating substrate of the aerosol-generating article when the article is inserted into the heating chamber. When the aerosol-generating article is depleted, the depleted article is removed and a fresh article is inserted into the heating chamber. During removal and insertion of articles and operation of the device, unwanted residues of aerosol-generating substrate may be left on the heating element or in the heating chamber.

Consequently, there is a need for removing unwanted residues from the heating element and the heating chamber.

For solving this and further objects, the present invention proposes an aerosol-generating device for generating an inhalable aerosol. The device comprises a heating chamber comprising a sidewall and a heating element arranged in the heating chamber. A pyrocatalytic material is applied to one or more of the heating element and the sidewall of the heating chamber as a coating. The heating element is configured for pyrocatalytic cleaning.

For removing residues from the heating element and/or the heating chamber, the present invention enables a thermal cleaning function. For facilitating this function, the heating element heats up to a temperature higher than the aerosol generating temperature. At this temperature, organic deposits are converted into volatile organic compounds, hydrocarbons and carbonized gas. This conversion is denoted hereinafter as pyrocatalytic cleaning. The terms "pyrocatalytic cleaning" encompass pyrolysis and oxidation. Carbonized deposits are easily removed by light brushing or shaking of the device after pyrocatalytic cleaning.

The aerosol-generating substrate may contain tobacco. The required cleaning temperature for conventional pyrolysis of tobacco deposits is high, for example around 500° C. This temperature can be reached by a typical heating element, but not in the entire heating chamber. Therefore, tobacco deposits in parts of the heating chamber which are not in direct contact with the heating element cannot be pyrolysed during the pyrolytic cycle in conventional devices. Because of the high required temperature, pyrocatalytic cleaning additionally requires a lot of energy. As heat-not-burn devices are often portable and battery powered, pyrocatalytic cleaning reduces the usage time of the device and reduces the lifetime of the battery. The present invention facilitates pyrocatalytic cleaning at a lower temperature due to the application of pyrocatalytic material. Temperatures for pyrocatalytic cleaning may be reduced to between 300° C. to 380° C. Pyrocatalytic cleaning may thus be facilitated in the whole heating chamber. Pyrocatalytic cleaning is more efficient due to the lower temperature needed and battery life can be increased.

The pyrocatalytic material is applied as a coating. Providing the pyrocatalytic material as a coating facilitates ease of application of the pyrocatalytic material. During manufacturing, the coating may be applied to the heating element and/or the sidewall of the heating chamber. The coating may be applied by different methods, including spray coating, powder coating, dipping or film coating processes.

The sidewall of the heating chamber preferably comprises the base of the heating chamber as well as the wall surrounding the longitudinal axis of the heating chamber. The heating chamber comprises an opening, which does not form part of the sidewall and is open for enabling the insertion of an aerosol-generating article. Alternatively, the sidewall may only comprise the wall surrounding the longitudinal axis of the heating chamber and not the base of the heating chamber. The heating chamber may have a hollow tubular shape for insertion of an aerosol-generating article with a cylindrical shape resembling a conventional cigarette. The opening of the heating chamber for inserting the article may be circular. The heating element may be configured as a heating blade arranged centrally in the heating chamber.

The pyrocatalytic material may comprise a catalyst and a binder. The catalyst can be cerium, copper, vanadium, bismuth, molybdenum, manganese, iron, nickel, platinum-group metals of tin, niobium, chromium, tungsten, rhenium, platinum, cobalt, oxides of said metals, and compounds of two or more of said metals and oxides.

The binder binds the catalyst material and can be a fluoropolymer, a ceramic material or an enamel frit. The catalyst may be a pyrolytic catalyst. The pyrolytic catalyst promotes pyrolytic cleaning of organic deposits at lower temperatures and thus reduces the energy required for thermal cleaning. The catalyst may be an oxidation catalyst. The catalyst may be a pyrolytic and an oxidation catalyst. The pyrocatalytic material may comprise one or more of a pyrolytic catalyst and an oxidation catalyst.

The binder may also be denoted as a carrier. The binder is configured to securely hold the catalyst. The binder may be configured to adhere to the heating element and/or the sidewall of the heating chamber. The catalyst may be embedded in the binder. The catalyst may be configured to be embedded in the binder predominantly facing the heating chamber. In other words, the catalyst material provided in the binder may be arranged to contact residues of aerosol-generating substrate which is to be removed, while the binder material predominantly adheres to the heating element and/or the sidewall of the heating chamber.

The binder may have high heat conductivity. The heat conductivity of the binder may facilitate heat transfer from the heating element towards the catalyst and the heating chamber, when the catalyst material is applied on the heating element. The heat conductivity of the binder in this regard is particularly beneficial when the heating element is provided within the heating chamber.

The heating element may be arranged centrally aligned along the longitudinal axis of the heating chamber. The heating element may be configured as a pin or blade.

A pin or blade is configured to penetrate into the aerosol-generating substrate of an aerosol-generating article during insertion of the aerosol-generating article into the heating chamber. The pin or blade is preferably centrally aligned along the longitudinal axis of the heating chamber. The pin or blade may be configured to induce pyrocatalytic cleaning. The pyrocatalytic cleaning may occur on the surface of the heating element thereby removing unwanted residues. The pyrocatalytic cleaning may also occur on the sidewall of the heating chamber thereby entirely cleaning the heating chamber as well as the heating element.

The heating element may also be provided as an external heater surrounding the heating chamber. In this embodiment, providing the binder with high heat conductivity facilitates heat transfer from the heating element through the sidewall and the binder towards the catalyst and the heating chamber.

The binder may be configured resistant to mechanical damage so that the catalyst material is not damaged or removed during operation of the device, particularly during insertion and removal of aerosol-generating articles.

The device further may comprise a closing means for at least partially closing, preferably hermetically closing, the heating chamber.

During pyrocatalytic cleaning, the air contained in the heating chamber is heated. When the heating chamber is open, heated air may escape from the heating chamber. Thus, pyrocatalytic cleaning may be negatively impaired by an open heating chamber. The closing means may prevent heated air from escaping from the heating chamber. Thus, less energy may be required for realizing pyrocatalytic cleaning.

The closing means may also realize a safety feature of the device. In this regard, the closing means may prevent a user from reaching into the heating chamber and injuring himself/herself. The closing means may comprise a sensor or poka yoke which interacts with a corresponding sensor or poka yoke arranged in the heating chamber so that the device detects that the closing means has been arranged to close the heating chamber. A controller of the device may then enable pyrocatalytic cleaning once the closing means has closed the heating chamber.

The closing means may comprise a lid. The lid may be configured for closing the heating chamber.

The lid may be removably attachable or fixed to the device. Removably attaching the lid may enable a user to remove the lid when a cleaning operation is not necessary. The user may store the lid during normal operation of the device separately from the device and use the lid to close the heating chamber during pyrocatalytic cleaning. Alternatively, the lid may be fixed to the device. In this embodiment, the lid is moved manually by the user for closing the heating chamber, when the user wants to initiate pyrocatalytic cleaning. Alternatively, the lid may automatically close when the user initiates pyrocatalytic cleaning.

The closing means may comprise a closeable air inlet. An air inlet may allow escape of heated air from the heating chamber during pyrocatalytic cleaning. Providing the air inlet closable may prevent heated air from escaping the heating chamber during pyrocatalytic cleaning.

The device may comprise an activation means such as a button for activating pyrocatalytic cleaning. The activation means may be configured as a button. Alternatively, the activation means may comprise a communication interface which communicates with an external device such as a smartphone or a smartwatch for activating the pyrocatalytic cleaning.

A thermal insulation layer may be arranged between the sidewall of the heating chamber and the pyrocatalytic material or around the heating chamber.

The thermal insulation layer may reduce the energy required for pyrocatalytic cleaning. The provision of the thermal insulation layer is particularly useful when the heating element is provided as an internal heater arranged inside of the heating chamber. In this case, the heat emitted by the heating element escaping the heating chamber may be reduced or prevented by means of the thermal insulation layer.

The aerosol-generating substrate may contain tobacco, wherein the pyrocatalytic material may be configured for reducing the required temperature for pyrolysis of tobacco below 380° C., preferably below 360° C., more preferably below 340° C. The required temperature for pyrolytic cleaning may be between 300° C. and 380° C. as a result of the pyrocatalytic material.

The temperature for normal operation of the aerosol-generating device during heating of the aerosol-generating substrate provided in the aerosol-generating article is increased for pyrocatalytic cleaning. However, the temperature normally necessary for facilitating pyrocatalytic cleaning is 380° C. This temperature can be reduced by means of the pyrocatalytic material applied on the heating element and/or the sidewall of the heating chamber. Hence, the heating element is configured to be heated during pyrocatalytic cleaning to a temperature above the temperature of the heating element for normal aerosol generation and below the temperature necessary for uncatalyzed pyrocatalytic cleaning of tobacco.

The invention further relates to a method for cleaning a heating chamber of an aerosol-generating device, the method comprising the following steps:

i) providing an aerosol-generating device comprising a heating chamber configured to receive an aerosol-generating article containing aerosol-generating substrate and a heating element arranged in the heating chamber;
ii) applying a pyrocatalytic material to one or more of the heating element and the sidewall of the heating chamber as a coating; and
iii) heating the heating element for removing unwanted residues from one or more of the heating element and the sidewall of the heating chamber.

The temperature of the heating element may during the heating step be increased above the normal aerosol-generating temperature and below 380° C., preferably below 360° C., more preferably below 340° C.

Figure 3:
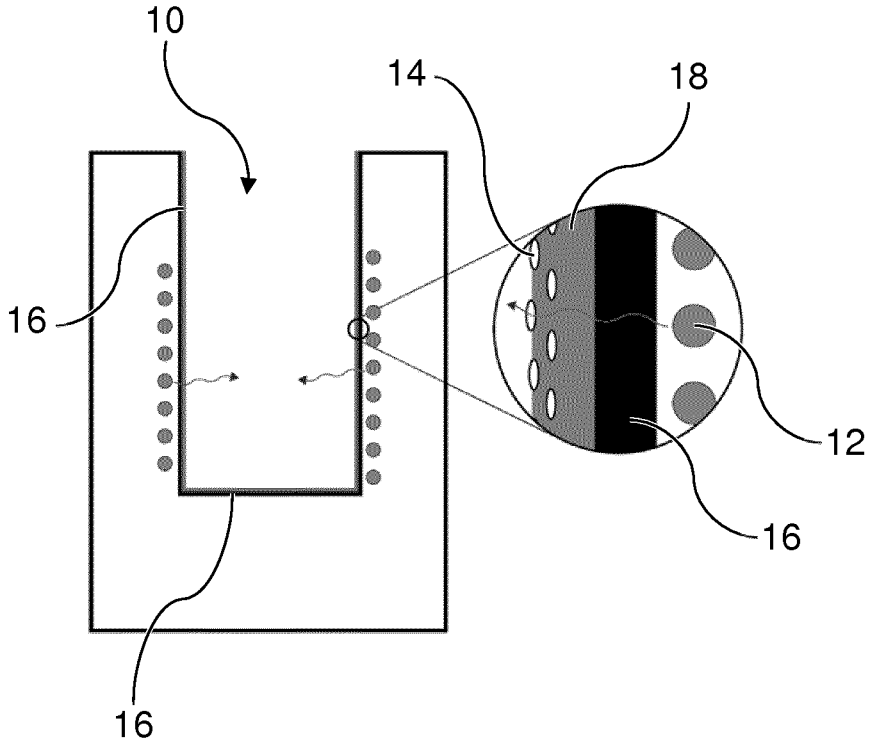

The invention will be described in more detail in the following with reference to the accompanying drawings, which show in:

FIG. 1: a heating chamber of an aerosol-generating device according to the present invention with pyrocatalytic material applied to a heating element and the sidewall of the heating chamber;

FIG. 2: embodiments in which the pyrocatalytic material is applied only to the heating element or the sidewall of the heating chamber; and FIG. 3: an embodiment of an external heating element.

FIG. 1 shows a heating chamber 10 of an aerosol-generating device. A heating element 12 is arranged within the heating chamber 10. A closing means, i.e., a lid 20, is removably attachable or fixed to the heating chamber 10. The heating element 12 is provided as a heating blade and is centrally aligned along the longitudinal axis of the heating chamber 10.

In FIG. 1, pyrocatalytic material comprising a catalyst 14 is applied to the heating element 12 as well as the sidewall 16 of the heating chamber 10. The pyrocatalytic material is provided as a coating and comprises the catalyst 14 as well as a binder 18. A thermal insulation layer 22 is arranged between the sidewall 16 of the heating chamber 10 and the pyrocatalytic material. A lid 20 includes sensors 22, 24 so that the device detects when the lid 20 has been arranged to close the heating chamber 10. A controller 26 is configured to enable pyrocatalytic cleaning once the lid 20 has closed the heating chamber 10.

The binder 18 is configured with high heat conductivity such that heat generated by the heating element 12 can be transferred towards the catalyst 14 as well as towards residues of aerosol-generating substrate sticking to the heating element 12 and the sidewall 16 of the heating chamber 10 after removal of an aerosol-generating article.

FIG. 2 shows embodiments in which the pyrocatalytic material is only applied to the heating element 12 in FIG. 2A and only applied to the sidewall 16 of the heating chamber 10 in FIG. 2B. When the pyrocatalytic material is only applied to the heating element 12, pyrocatalytic cleaning may be enabled on the surface of the heating element 12 with a temperature which is reduced in comparison to the typical temperature necessary for pyrocatalytic cleaning of 380° C. If the pyrocatalytic material is provided on the sidewall 16 of the heating chamber 10, pyrocatalytic cleaning may be facilitated on the surface of the heating element 12 as well as on the sidewall 16 of the heating chamber 10 due to the fact that the temperature necessary for a pyrocatalytic cleaning on the sidewall 16 is lower in comparison to the temperature necessary on the surface of the heating element 12. In this regard, the heating element 12 may be configured to be heated to a temperature of around 380° C. on the surface of the heating element 12, while the temperature achievable on the sidewall 16 of the heating chamber 10 may be lower. Due to the pyrocatalytic material provided on the sidewall 16 of the heating chamber 10, this lower temperature may still be sufficient to enable pyrocatalytic cleaning.

FIG. 3 shows an embodiment of the heating element 12, in which the heating element 12 is provided as an external heater. In comparison to FIGS. 1 and 2, in which the heating element 12 is provided as an internal heater, the external heater shown in FIG. 3 is arranged surrounding the sidewall 16 of the heating chamber 10. The binder 18 and preferably also the sidewall 16 of the heating chamber 10 may be provided in this embodiment with a high heat conductivity to enable heat transfer from the external heating element 12 through the sidewall 16 of the heating chamber 10 and the binder 18 towards the catalyst 14 as well as residues of aerosol-generating substance remaining in the heating chamber 10.

The invention claimed is:

1. An aerosol-generating device for generating an inhalable aerosol, the aerosol-generating device comprising:

a heating chamber comprising a sidewall; and a heating element disposed in the heating chamber, wherein a pyrocatalytic material is applied to a sidewall of the heating chamber as a coating, and wherein the heating element is configured for pyrocatalytic cleaning.

2. The aerosol-generating device according to claim 1, wherein the pyrocatalytic material comprises a catalyst and a binder.

3. The aerosol-generating device according to claim 2, wherein the binder is heat conductive.

4. The aerosol-generating device according to claim 1, wherein the heating element is configured as a pin or as a blade.

5. The aerosol-generating device according to claim 1, further comprising a closing means for at least partially closing the heating chamber.

6. The aerosol-generating device according to claim 1, further comprising a closing means for hermetically closing the heating chamber.

7. The aerosol-generating device according to claim 5, wherein the closing means comprises a lid.

8. The aerosol-generating device according to claim 7, wherein the lid is removably attachable or fixed to the aerosol-generating device.

9. The aerosol-generating device according to claim 5, wherein the closing means comprises a closeable air inlet.

10. The aerosol-generating device according to claim 1, further comprising an aerosol-generating substrate, which contains tobacco, wherein the pyrocatalytic material is configured for reducing a required temperature for pyrolysis of the tobacco below 380° C.

11. The aerosol-generating device according to claim 1, further comprising an aerosol-generating substrate, which contains tobacco, wherein the pyrocatalytic material is configured for reducing a required temperature for pyrolysis of the tobacco below 340° C.

12. The aerosol-generating device according to claim 1, wherein the pyrocatalytic material is configured for reducing a required temperature for pyrolytic cleaning to between 300° C. and 380° C.

13. The aerosol-generating device according to claim 1, wherein the aerosol-generating device is handheld, has a battery, and is portable.

14. The aerosol-generating device according to claim 1, wherein the pyrocatalytic material is configured for reducing a required temperature for pyrolysis of tobacco.

15. The aerosol-generating device according to claim 1, wherein the pyrocatalytic material is applied to the heating element and the sidewall of the heating chamber as a coating.

16. The aerosol-generating device according to claim 5, wherein the closing means comprises a sensor or poka yoke that interacts with a corresponding sensor or poka yoke arranged in the heating chamber so that the aerosol-generating device detects that the closing means has been arranged to close the heating chamber, and wherein the aerosol-generating device further comprises a controller configured to enable pyrocatalytic cleaning once the closing means has closed the heating chamber.

* * * * *